US008141173B2

(12) United States Patent
Sterling

(10) Patent No.: US 8,141,173 B2
(45) Date of Patent: Mar. 27, 2012

(54) SHOWER GARMENT

(76) Inventor: Stephen M. Sterling, Bradenton, FL (US)

( * ) Notice: Subject to any disclaimer, the term of this patent is extended or adjusted under 35 U.S.C. 154(b) by 23 days.

(21) Appl. No.: 12/578,004

(22) Filed: Oct. 13, 2009

(65) Prior Publication Data

US 2010/0107296 A1 May 6, 2010

Related U.S. Application Data

(60) Provisional application No. 61/111,144, filed on Nov. 4, 2008.

(51) Int. Cl.
*A41D 5/00* (2006.01)

(52) U.S. Cl. ..... 2/67; 2/70

(58) Field of Classification Search ..... 2/88, 84, 2/67, 69, 171.2, 174, 69.5, 85, 80, 83, 94, 2/95, 108, 89, 247, 250, 76, 49.1, 49, 48, 2/46, 50, 51, 114, 112, 113, 115, 52, 105, 2/106, 71, 47, 227, 92, 211, 221, 208; 132/212; 15/208, 209.1, 210, 1; 224/677, 684, 682, 224/934, 901.4, 901.6, 241, 236, 683; 450/96; 5/485

See application file for complete search history.

(56) References Cited

U.S. PATENT DOCUMENTS

| | | | | |
|---|---|---|---|---|
| 1,966,060 | A | 7/1934 | Cohen | |
| 2,018,782 | A | 10/1935 | Gephart | |
| 2,019,248 | A * | 10/1935 | Blumgardt | 2/93 |
| 3,793,645 | A * | 2/1974 | Kadison | 2/221 |
| 4,104,742 | A | 8/1978 | Rahaim | |
| 5,033,986 | A * | 7/1991 | Feigenbaum et al. | 450/30 |
| 5,174,305 | A * | 12/1992 | Childs | 128/846 |
| 5,327,586 | A * | 7/1994 | Evans et al. | 2/211 |
| 5,575,006 | A | 11/1996 | Wolfe | |
| 5,694,643 | A | 12/1997 | Fujiwara | |
| D396,543 | S * | 8/1998 | Owen | D2/851 |
| 6,374,415 | B1 | 4/2002 | Lenart | |
| 6,859,940 | B1 * | 3/2005 | Sholander | 2/69 |
| D576,379 | S * | 9/2008 | Najarian | D2/864 |
| 2003/0014804 | A1 * | 1/2003 | Morales | 2/92 |
| 2006/0218690 | A1 * | 10/2006 | James | 2/69 |
| 2007/0017000 | A1 * | 1/2007 | Segal | 2/69 |
| 2007/0101481 | A1 * | 5/2007 | Stokesbary | 2/211 |
| 2007/0157359 | A1 | 7/2007 | Reardon et al. | |
| 2008/0115250 | A1 | 5/2008 | Tousant | |
| 2009/0293168 | A1 * | 12/2009 | Lugtu | 2/69 |

* cited by examiner

*Primary Examiner* — Gary L Welch
*Assistant Examiner* — Khaled Annis
(74) *Attorney, Agent, or Firm* — Fraser Clemens Martin & Miller LLC; J. Douglas Miller

(57) ABSTRACT

A garment for use in a shower is disclosed. The shower garment includes a first panel, a second panel, and a strap. The strap has a first end releasably coupled to a second end thereof and is adapted to extend around a waist of a user. The first panel and the second panel depend from the strap and substantially cover the pelvic region and the buttocks, respectively, of the user.

6 Claims, 2 Drawing Sheets

SHOWER GARMENT

CROSS-REFERENCE TO RELATED APPLICATION

This application claims the benefit of U.S. Provisional Patent Application Ser. No. 61/111,144 filed on Nov. 4, 2008, hereby incorporated herein by reference in its entirety.

FIELD OF THE INVENTION

The invention relates to garments, and more specifically to a shower garment adapted to provide privacy in a shower.

BACKGROUND OF THE INVENTION

Facilities such as schools, camps, gymnasiums, and military and penal institutions typically provide open showers for use by patrons. An open shower is a shower area intended to be used by more than one person concurrently, where the person may be seen by other concurrent users of the shower. Open showers provide a cost effective way to provide shower access to more than one person while simplifying maintenance and cleaning of the shower area. While beneficial to a provider of the open shower, a privacy of the person using the shower is compromised.

Modesty or religious beliefs may cause users to wear undergarments or swim attire while using the open shower. Additionally, the presence of the open shower may deter modest users (especially children) from participating in activities at the facilities. Further, as childhood obesity rates rise, the open shower may promote an environment of criticism, further deterring use of the open shower. While effective at providing a higher degree of privacy, undergarments or swim attire tend to restrict body washing accessibility. In addition, undergarments may be formed from absorbent materials such as cotton that do not dry easily. Further, undergarments and swim attire for women generally do not provide pockets for storage of shower items such as soap and shampoo, which are generally brought into the open shower by the user.

It would be desirable to have a shower garment adapted to provide privacy in an open shower; maximize access for body washing; and provide storage means for shower items.

SUMMARY OF THE INVENTION

Compatible and attuned with the invention, a shower garment adapted to provide privacy in an open shower; maximize access for body washing; and provide storage means for shower items, has surprisingly been discovered.

The above objectives, as well as others, may be achieved by a shower garment comprising a first panel to substantially cover a pelvic region of a user; a second panel to substantially cover a buttocks of the user; and a strap having a first end releasably coupled to a second end thereof, the strap adapted to extend around a waist of the user, wherein the first panel and the second panel depend from the strap.

The above objective may also be achieved by a shower garment comprising a first panel having a first edge, a spaced apart second edge, and a first storage compartment formed in the first panel between the first edge and the second edge thereof, the first panel adapted to substantially cover a pelvic region of a user; a second panel having a first edge, a spaced apart second edge, and a second storage compartment formed in second panel between the first edge and the second edge thereof, the second panel adapted to substantially cover a buttocks of the user; and a strap having a first end and a second end and including a fastening member to releasably couple the first end of the strap to the second end of the strap, the strap adapted to extend around a waist of the user, wherein the first edge of the first panel is coupled to the strap adjacent the first end of the strap and the first edge of the second panel is coupled to the strap adjacent the second end of the strap.

The above objective may also be achieved by a shower garment comprising a first panel formed from a fabric having a first edge, a spaced apart second edge, and at least one first storage compartment formed in the first panel between the first edge and the second edge thereof, the first panel adapted to substantially cover a pelvic region of a user; a second panel formed from a fabric having a first edge, a spaced apart second edge, and at least one second storage compartment formed in the second panel between the first edge and the second edge thereof, the second panel adapted to substantially cover a buttocks of the user; and a strap formed from a fabric having a first end and a second end with an elastic portion disposed therebetween, the strap including a fastening member to releasably couple the first end of the strap to the second end of the strap, the strap adapted to extend around a waist of the user, wherein the first edge of the first panel is coupled to the strap adjacent the first end of the strap and the first edge of the second panel is coupled to the strap adjacent the second end of the strap.

BRIEF DESCRIPTION OF THE DRAWINGS

The above, as well as other objects and advantages of the invention, will become readily apparent to those skilled in the art from the following detailed description of an embodiment of the invention when considered in the light of the accompanying figures, in which.

DETAILED DESCRIPTION OF A PREFERRED EMBODIMENT OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
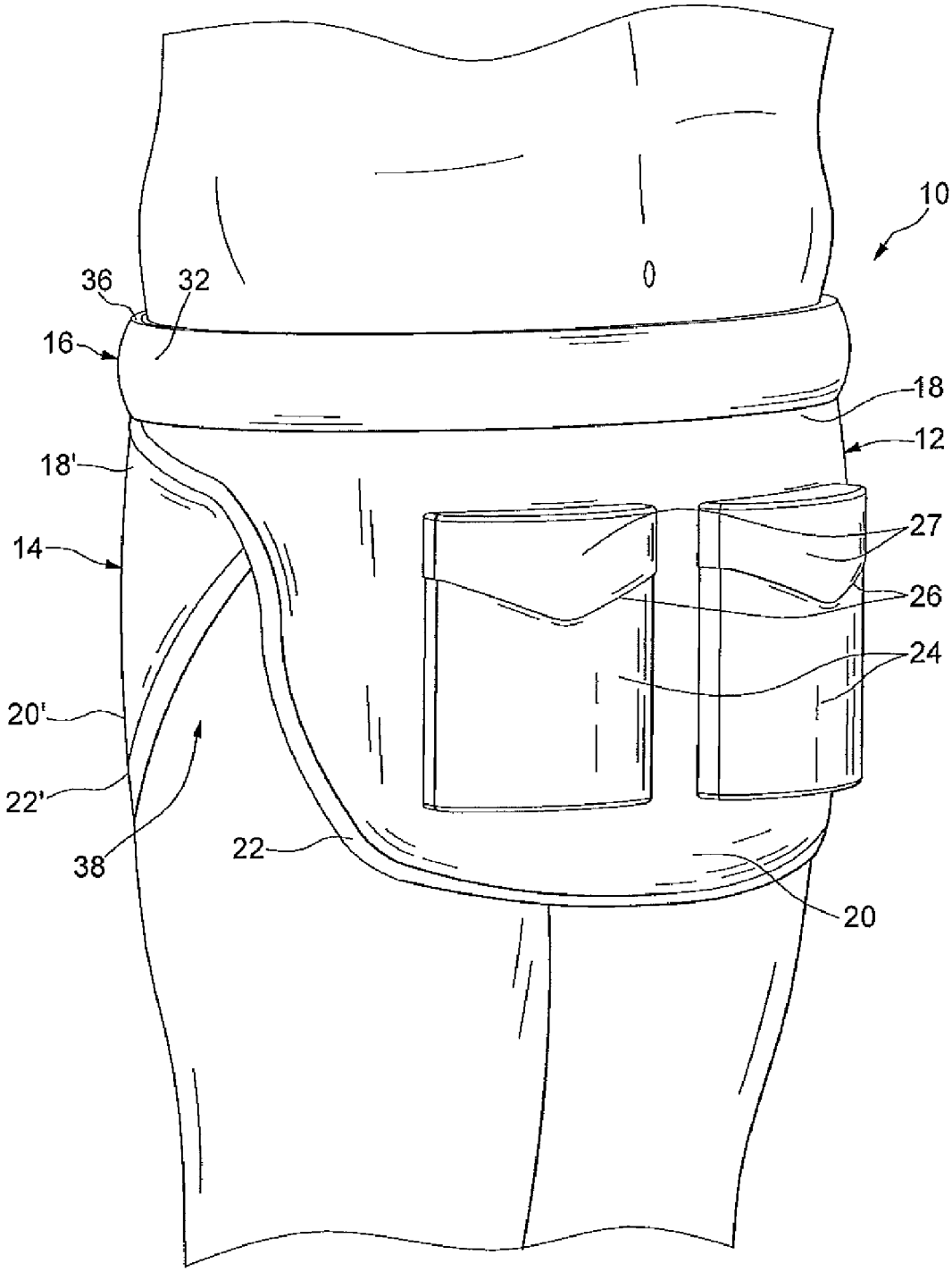
FIG. 1 is a front perspective view of a shower garment according to an embodiment of the invention shown being worn by a user.
Figure 2:
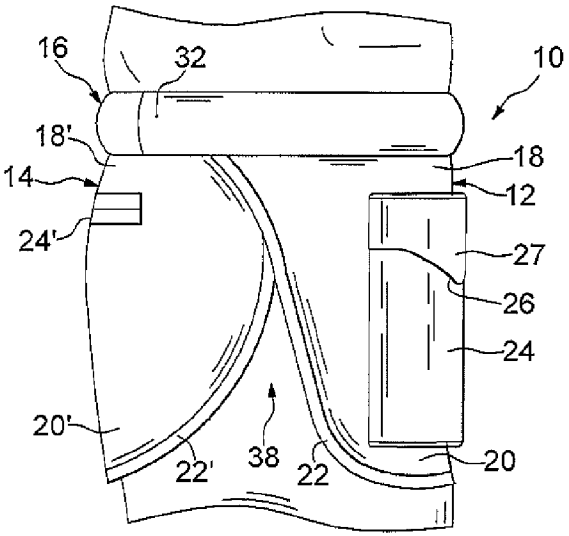
FIG. 2 is a side elevational view of the shower garment illustrated in FIG. 1 shown being worn by a user.
Figure 3:
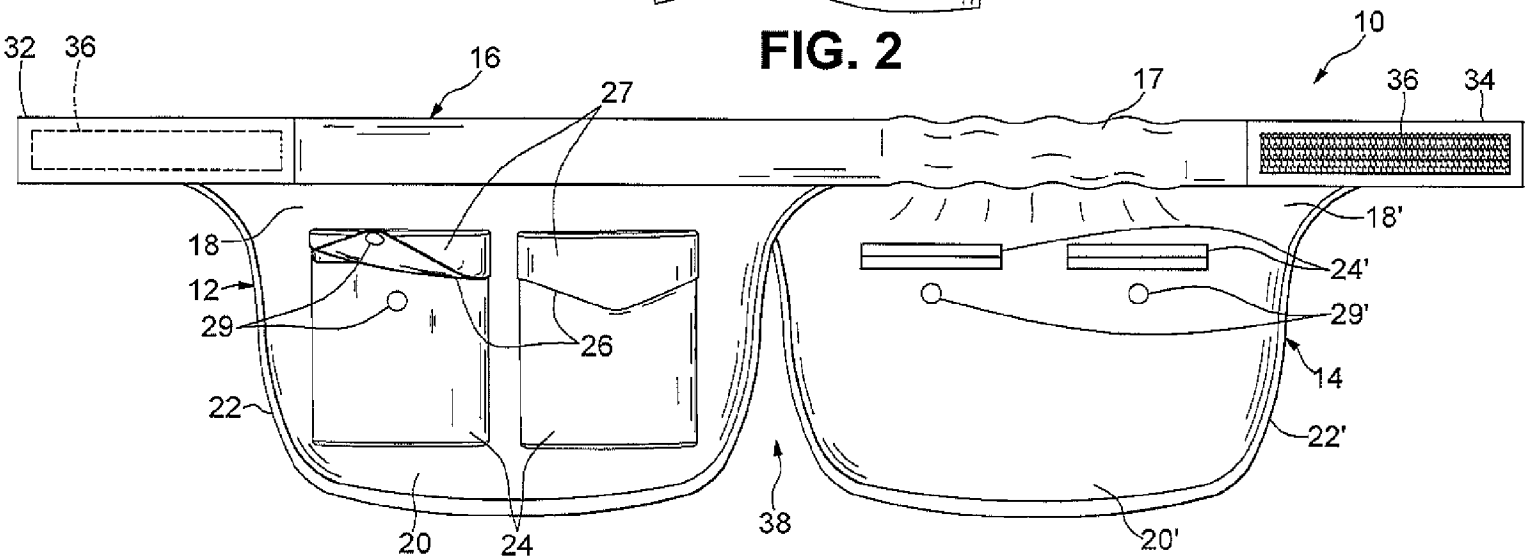
FIG. 3 is a side elevational view of the shower garment illustrated in FIG. 1 shown in an uncoupled state.

Referring to FIGS. 1-3, there is illustrated a shower garment 10 which embodies the present invention. The shower garment 10 includes a first panel 12, a second panel 14, and a strap 16. As illustrated in FIG. 1, the shower garment 10 is to be worn around the waist of a shower user.

The first panel 12 has a first edge 18 and a second edge 20. The first edge 18 is coupled to the strap 16 along an entire width of the first panel 12 by means such as sewing, an adhesive, or other suitable fastening means. The first panel 12 may be rectangularly shaped, trapezoidally shaped, semicircularly shaped, or any other suitable shape. The first panel 12 is typically shaped to substantially cover a pelvic region of the user. It should be understood that the first panel 12 is preferably formed from a quick drying or non-absorbent fabric such as polyester, nylon, acrylic, or any other suitable material. It is understood the fabric may be porous to allow adequate rinsing of the shower garment 10. The first panel 12 may be comprised of a plurality of layers formed from different materials. A binding 22 or other finish may be included along an edge of the first panel 12 to militate against the fraying thereof. The first panel 12 typically includes a storage compartment or pocket 24. The storage compartment 24 may be formed from a quick drying or non-absorbent fabric such as polyester, nylon, acrylic, or any other suitable material coupled to the first panel 12. The storage compartment 24 may be one of an internal and an external storage compartment, dependent on a side of the first panel 12 it is disposed on. In the illustrated embodiment, the first panel 12 includes two external storage compartments 24 each having a releasable closure 26 to selectively close the storage compartment 24. However, the first panel 12 may include one storage compartment 24 or more than two storage compartments 24. The releasable closure 26 may be one of, or a combination of, a flap 27 and a fastener 29, wherein the fastener is one of a button, a snap, a clasp, a hook and loop tape, and the like, for example. It should be understood that the storage compartment 24 may be formed to include a mesh or net-like material.

Reference numerals for similar structure in respect of the above description are repeated below with a prime (') symbol.

The second panel 14 has a first edge 18' and a second edge 20'. The first edge 18' is coupled to the strap 16 along the width of the second panel 14 by sewing, an adhesive, or by any other suitable fastening means. The second panel 14 may be rectangularly shaped, trapezoidally shaped, semi-circularly shaped, or any other suitable shape. The second panel 14 is typically shaped to substantially cover a buttocks of the user. It should be understood that the second panel 14 is typically formed from a quick drying or non-absorbent fabric such as polyester, nylon, acrylic, or any other suitable material. It is understood the fabric may be porous to allow adequate rinsing of the shower garment 10. The second panel 14 may be comprised of a plurality of layers formed from different materials. The binding 22' or other finish may be included along an edge of the second panel 14 to militate against the fraying thereof. The second panel 14 typically includes the storage compartment or pocket 24'. The storage compartment 24' may be formed from a quick drying or non-absorbent fabric such as polyester, nylon, acrylic, or any other suitable material. The storage compartment 24' may be one of an internal and an external storage means, dependent on a side of the second panel 12 it is disposed on. In the illustrated embodiment, the second panel 14 includes two internal storage compartments 24'. However, the second panel 14 may include one storage compartment 24' or more than two storage compartments 24'. It should be understood that a releasable closure can be provided for the storage compartment 24' to selectively close the storage compartment 24'. The releasable closure may be one of, or a combination of, a flap and a fastener 29', wherein the fastener is a button, a snap, a clasp, a hook and loop tape, and the like, for example. Additionally, it should be understood that the storage compartment 24' may be formed to include a mesh or net-like material.

The strap 16 is an elongate piece of fabric coupled to the first panel 12 and the second panel 14. The strap 16 has a first end 32 and a second end 34. The first end 32 is releasably coupled to the second end 34 by a fastening member 36. The fastening member 36 is typically a hook and loop closure. However, other fastening means such as a snap, a button, a clasp, a buckle, and the like, for example, may be used. One type of hook and loop closure is commercially available as Velcro® from Velcro USA Inc. It should be understood that at least a portion of the strap 16 may be formed from an elastic material 17. The remaining portion of the strap 16 may be formed from a quick drying or non-absorbent fabric such as polyester, nylon, acrylic, or any other suitable material.

In use, the shower garment 10 is adapted to provide privacy in an open shower. In anticipation of showering, a user of the shower garment 10 releases the fastening member 36, separating the first end 32 from the second end 34. The strap 16 is disposed around the waist and is secured by the fastening member 36. The elastic portion 17 of the strap 16 facilitates a snug fit for a variety of waist sizes. The shower garment 10 may be donned before or after disrobing. When the shower garment 10 is donned before disrobing, the shower garment 10 facilitates easy access to remove any attire below the waist of the user. The hands of the user may be inserted through a pair of interstices 38 formed between the first panel 12 and the second panel 14 to aid in disrobing. The user may also place shower items such as a bar of soap, shampoo, a razor, or other shower items into one of the storage compartments 24, 24' disposed on one of the first panel 12 and the second panel 14, respectively. Accordingly, the privacy of the user is maintained by the shower garment 10 during disrobing in anticipation of showering.

During showering, the shower garment 10 allows unrestricted access to wash the body of the user. When a portion of the body of the user concealed by the shower garment 10 is desired to be washed, the hands of the user may be inserted through the pair of interstices 38. The pair of interstices 38 is formed between the first panel 12 and the second panel 14, and below an area of overlap between the first panel 12 and the second panel 14. Each end of the first edge 18 of the first panel 12 overlaps an end of the first edge 18' of the second panel 14 to form the area of overlap. The interstices 38 are formed to aid washing of the concealed body portions. Additionally, access to concealed portions of the body of the user is facilitated through an open bottom of the shower garment 10. Further, immediate access to the shower items placed into the storage compartment 24 by the user is facilitated by the proximity of the storage compartment 24.

After showering, the user of the shower garment 10 may dry in a usual manner with a towel or other absorbent material. When a portion of the body of the user concealed by the shower garment 10 is desired to be dried, the hands of the user and a towel may be inserted through the pair of interstices 38 formed between the first panel 12 and the second panel 14 to aid drying of the concealed portions. Additionally, access to concealed portions of the body of the user is facilitated through the open bottom of the shower garment 10. The quick drying or non-absorbent fabric of the shower garment 10 militates against inconvenience that may be caused by an absorbent material. After drying, the user may continue to wear the shower garment 10 while dressing to provide privacy. The shower garment 10 facilitates access to don any attire below the waist of the user. The hands of the user may be inserted through the pair of interstices 38 formed between the first panel 12 and the second panel 14 to aid in dressing. After dressing, the user releases the fastening member 36 and removes the shower garment 10. It should be understood that the shower garment 10 may also be employed by the user to provide privacy while undressing and dressing, without showering.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A shower garment comprising:

a first panel having a first edge, a spaced apart second edge, and a first storage compartment formed in the first panel between the first edge and the second edge thereof, the first panel substantially covering a pelvic region of a user;

a second panel having a first edge, a spaced apart second edge, and a second storage compartment formed in second panel between the first edge and the second edge thereof, the second panel substantially covering a buttocks of the user; and an elongate strap having a first end and a second end and including a fastening member to releasably couple the first end of the strap to the second end of the strap, the strap circumscribing a waist of the user, wherein the first edge of the first panel is coupled to the strap adjacent the first end of the strap and the first edge of the second panel is coupled to the strap adjacent the second end of the strap, wherein the first panel and the second panel each has a pair of opposing serpentine-shaped side edges, and the first panel and the second panel overlap adjacent the elongate strap and only at top portions of the first panel and the second panel and not at bottom portions of the first panel and the second panel, and each of the first panel and second panel is connected only to the strap, wherein a pair of interstices is formed between the first panel and the second panel where the first panel and the second panel do not overlap, and wherein the strap has a front portion adjacent the pelvic region of the user from which the first panel depends and a rear portion adjacent the buttocks of the user from which the second panel depends, only the rear portion having an elastic material.

2. The shower garment according to claim 1, wherein at least one of the first storage compartment and the second storage compartment include a releasable closure adapted to selectively close the one of the first storage compartment and the second storage compartment.

3. The shower garment according to claim 2, wherein the releasable closure is at least one of a flap, a snap, a button, a clasp, a buckle, and a hook and loop tape.

4. The shower garment according to claim 1, wherein the first panel, the second panel, and the strap are formed from one of a polyester, a nylon, and an acrylic.

5. A shower garment comprising:

a first panel formed from a fabric having a first edge, a spaced apart second edge, and at least one first storage compartment formed in the first panel between the first edge and the second edge thereof, the first panel substantially covering a pelvic region of a user;

a second panel formed from a fabric having a first edge, a spaced apart second edge, and at least one second storage compartment formed in the second panel between the first edge and the second edge thereof, the second panel substantially covering a buttocks of the user; and an elongate strap formed from a fabric having a first end and a second end, the strap including a fastening member to releasably couple the first end of the strap to the second end of the strap, the strap circumscribing a waist of the user, wherein the first edge of the first panel is coupled to the strap adjacent the first end of the strap and the first edge of the second panel is coupled to the strap adjacent the second end of the strap, wherein the first panel and the second panel each has a pair of opposing serpentine-shaped side edges, and the first panel and the second panel overlap adjacent the elongate strap and only at top portions of the first panel and the second panel and not at bottom portions of the first panel and the second panel, and each of the first panel and second panel is connected only to the strap, wherein a pair of interstices is formed between the first panel and the second panel where the first panel and the second panel do not overlap, and wherein the strap has a front portion adjacent the pelvic region of the user from which the first panel depends and a rear portion adjacent the buttocks of the user from which the second panel depends, only the rear portion having an elastic material.

6. The shower garment according to claim 5, wherein at least one of the at least one first storage compartment and the at least one second storage compartment include a releasable closure to selectively close the at least one first storage compartment and the at least one second storage compartment.

* * * * *